US010119360B2

(12) United States Patent
Kellner et al.

(10) Patent No.: US 10,119,360 B2
(45) Date of Patent: Nov. 6, 2018

(54) SLIP SEGMENT FOR A DOWNHOLE TOOL

(71) Applicant: TEAM OIL TOOLS, LP, The Woodlands, TX (US)

(72) Inventors: Justin Kellner, Adkins, TX (US); Joshua Magill, Cypress, TX (US)

(73) Assignee: INNOVEX DOWNHOLE SOLUTIONS, INC., The Woodlands, TX (US)

( * ) Notice: Subject to any disclaimer, the term of this patent is extended or adjusted under 35 U.S.C. 154(b) by 5 days.

(21) Appl. No.: 15/064,312

(22) Filed: Mar. 8, 2016

(65) Prior Publication Data

US 2017/0260824 A1 Sep. 14, 2017

(51) Int. Cl.

| | |
|---|---|
| ***E21B 23/01*** | (2006.01) |
| ***E21B 33/129*** | (2006.01) |
| ***B22F 7/06*** | (2006.01) |

(52) U.S. Cl.

CPC ..... *E21B 33/1293* (2013.01); *B22F 7/06* (2013.01)

(58) Field of Classification Search

CPC .... E21B 47/024; E21B 47/0905; E21B 47/12; E21B 7/06; E21B 7/067

See application file for complete search history.

(56) References Cited

U.S. PATENT DOCUMENTS

| | | | | |
|---|---|---|---|---|
| 5,984,007 | A | 11/1999 | Yuan et al. | |
| 6,167,963 | B1 | 1/2001 | McMahan et al. | |
| 6,220,349 | B1 | 4/2001 | Vargus et al. | |
| 6,976,534 | B2 | 12/2005 | Sutton et al. | |
| 8,047,279 | B2 | 11/2011 | Barlow et al. | |
| 8,887,818 | B1 | 11/2014 | Carr et al. | |
| 8,991,485 | B2 | 3/2015 | Chenault et al. | |
| 2003/0099506 | A1* | 5/2003 | Mosing | E21B 19/10 403/318 |
| 2011/0005779 | A1 | 1/2011 | Lembcke | |
| 2014/0224477 | A1* | 8/2014 | Wiese | E21B 33/1291 166/179 |
| 2014/0262214 | A1 | 9/2014 | Mhaskar et al. | |
| 2015/0027737 | A1* | 1/2015 | Rochen | E21B 23/01 166/382 |
| 2017/0218711 | A1 | 8/2017 | Kash | |

* cited by examiner

*Primary Examiner* — D. Andrews
*Assistant Examiner* — Dany E Akakpo
(74) *Attorney, Agent, or Firm* — MH2 Technology Law Group LLP

(57) ABSTRACT

An insert for a slip of a downhole tool including a base, a first button, a second button, and a connecting member. The first and second buttons extend from the base and are configured to engage an inner diameter surface of a tubular. The connecting member extends from the base and is positioned between the first button and the second button.

17 Claims, 9 Drawing Sheets

SLIP SEGMENT FOR A DOWNHOLE TOOL

BACKGROUND

A plug is a type of downhole tool that is designed to isolate two (e.g., axially-offset) portions of a wellbore. More particularly, once the plug is set in the wellbore, the plug isolates upper and lower portions of the wellbore while the upper portion is tested, cemented, stimulated, produced, injected into, or the like. The plug may be a bridge plug or a frac plug.

The plug includes one or more slips that are configured to expand radially-outward and into contact with an outer tubular (e.g., a casing) or the wall of the wellbore when the plug is set, to anchor the plug in place. The outer radial surfaces of the slips typically include a plurality of teeth that are configured to "bite" into the outer tubular or the wall of the wellbore to improve the strength of the anchor.

The slips may be made from metal, such as cast iron, or a composite (e.g., fiber-reinforced glass or other such) material. In the latter case, the composite material makes the plug easier to mill out of the wellbore when its use is complete. However, composite materials generally cannot bite into a metal casing (or any other type of surrounding tubular) with sufficient force to resist movement under high pressure. Accordingly, "buttons" made of a harder material, such as carbide or ceramic, are sometimes bonded to the composite slips, which provide the point of contact with the casing. These buttons, however, are prone to detaching from the slips in the well. Further, the size of the buttons is generally constrained, because the buttons can be difficult to mill. The buttons also add to the cost of the plug and complicate the assembly.

SUMMARY

An insert for a slip of a downhole tool is disclosed. The insert includes a base, a first button, a second button, and a connecting member. The first and second buttons extend from the base and are configured to engage an inner diameter surface of a tubular. The connecting member extends from the base and is positioned between the first button and the second button.

A slip segment for a downhole tool is also disclosed. The slip segment includes an arcuate body and an insert. The insert includes a base, a first button, a second button, and a connecting member. The base is at least partially embedded within an outer surface of the body. The first button and the second button extend from the base and are configured to engage an inner diameter of a tubular. The connecting member extends outward from the base and is positioned between the first button and the second button.

A method of manufacturing a slip segment for a downhole tool is also disclosed. The method includes positioning an insert in a mold. The insert includes buttons and a connecting member extending between the buttons. A composite material is introduced into the mold. The composite material solidifies after being introduced into the mold and forms an arcuate slip segment made of the composite material. A portion of the composite material is positioned over the connecting member to embed a portion of the insert within the slip segment.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
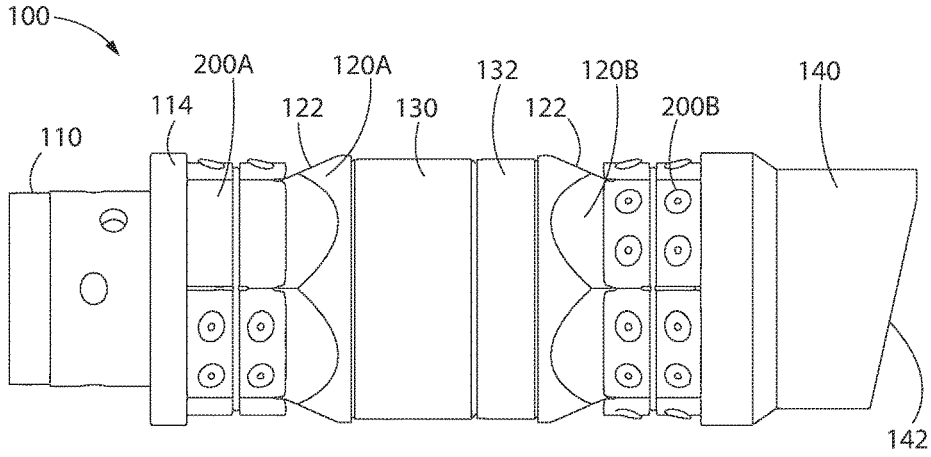
FIG. 1 illustrates a side view of a downhole tool, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

In general, the present disclosure provides a downhole tool, such as a plug, that includes one or more slips. The slips each include a plurality of inserts coupled to (e.g., at least partially embedded within) the outer radial surface thereof. The inserts each include a base, first and second buttons extending outward from the base, and a connecting member extending outward from the base and positioned between the first and second buttons, with, in some embodiments, the base, the first and second buttons, and the connecting member being formed from a single, monolithic piece. The buttons may engage an outer tubular (e.g., a casing) when the slips expand radially-outward.

Figure 2:
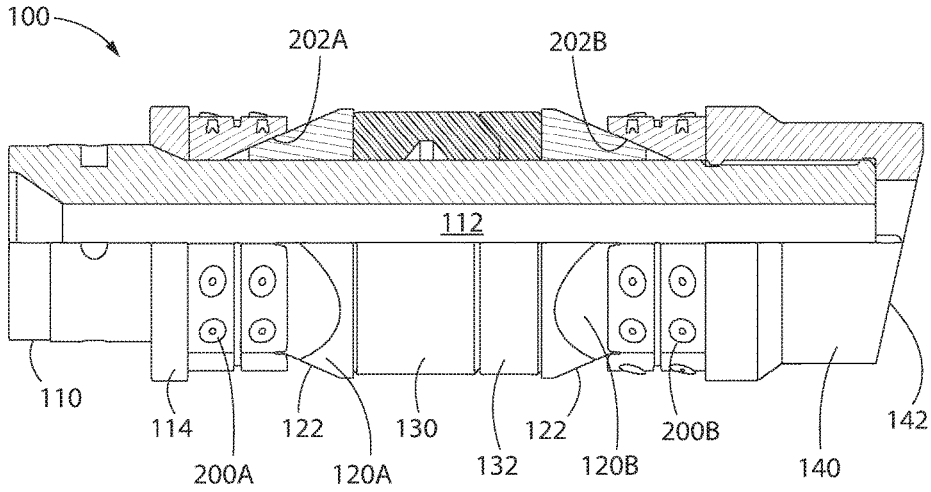
FIG. 2 illustrates a quarter-sectional side view of the downhole tool, according to an embodiment.

Turning to the specific, illustrated embodiments, FIG. 1 illustrates a side view of a downhole tool 100, and FIG. 2 illustrates a partial cross-sectional side view of the downhole tool 100, according to an embodiment. As shown, the downhole tool 100 may be a plug (e.g., a bridge plug or a frac plug). However, in other embodiments the downhole tool 100 may be any tool that is configured to be run into a wellbore and set (e.g., radially-outward) to engage an outer tubular (e.g., a casing) or wellbore wall, to anchor the tool in place.

As shown, the downhole tool 100 may include a body or mandrel 110 having an axial bore 112 formed at least partially therethrough. In at least one embodiment, a solid insert may be positioned in the bore 112 to prevent fluid flow therethrough in both axial directions. In another embodiment, a valve (e.g., a flapper valve) may be positioned in the bore 112 to prevent fluid flow therethrough in only one axial direction while allowing fluid flow in the opposing axial direction. In yet another embodiment, the bore 112 may define a shoulder that is configured to receive an impediment (e.g., a ball) that is introduced into the wellbore from the surface.

A push sleeve 114 may be positioned around the mandrel 110. The push sleeve 114 may be configured to move axially (e.g., downward) with respect with the mandrel 110 to set the downhole tool 100. The push sleeve 114 may also include a locking mechanism designed to prevent the sleeve from moving back (e.g., upward) with respect to the mandrel 110 after the downhole tool 110 is set.

One or more slips (two are shown: 200A, 200B) may also be positioned around the mandrel 110 and below the push sleeve 114. The slips may include a first, upper slip 200A and a second, lower slip 200B. The slips 200A, 200B may include inner surfaces 202A, 202B (FIG. 2), respectively. At least a portion of the inner surfaces 202A, 202B of the slips 200A, 200B may be tapered. As shown, the diameter of the inner surface 202A of the upper slip 200A may increase proceeding downward, and the diameter of the inner surface 202B of the lower slip 200B may decrease proceeding downward. The slips 200A, 200B may be made of a composite material (e.g., carbon reinforced fiber). In another embodiment, the slips 200A, 200B or a portion of the slips 200A, 200B (such as a segment 230 and/or an insert 300) may be made of a material that dissolves after a predetermined amount of time in contact with a fluid in a wellbore, or upon contact with a fluid of a predetermined composition, or both.

One or more cones (two are shown: 120A, 120B) may also be positioned around the mandrel 110 and between the slips 200A, 200B. The cones may include a first, upper cone 120A and a second, lower cone 120B. The cones 120A, 120B may include outer surfaces 122. At least a portion of the outer surfaces 122 of the cones 120A, 120B may be tapered. As shown, the diameter of the outer surface 122 of the upper cone 120A may increase proceeding downward, and the diameter of the outer surface 122 of the lower cone 120B may decrease proceeding downward. The inner surfaces 202A, 202B of the slips 200A, 200B may be oriented at substantially the same angle as the outer surfaces 122 of the cones 120A, 120B. This may enable the slips 200A, 200B to slide axially-toward one another and radially-outward along the outer surfaces 122 of the cones 120A, 120B as the downhole tool 100 is set.

One or more sealing elements (two are shown: 130, 132) may also be positioned around the mandrel 110. The sealing elements 130, 132 may be positioned axially-between the cones 120A, 120B. The sealing elements 130, 132 may be configured to expand radially-outward and into contact with a surrounding tubular (e.g., casing) or wellbore wall when the downhole tool 100 is set.

A shoe 140 may also be positioned around the mandrel 110. The shoe 140 may be positioned below the push sleeve 114, the slips 200A, 200B, the cones 120A, 120B, and the sealing elements 130, 132. The shoe 140 may be stationary with respect to the mandrel 110. The lower axial surface 142 of the shoe 140 may be tapered.

Figure 3:
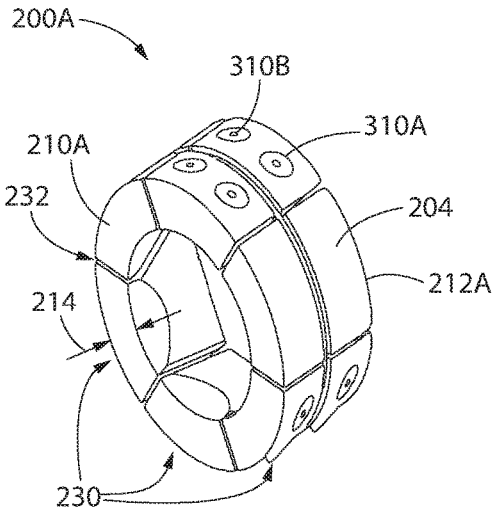
FIG. 3 illustrates a perspective view showing an upper end of a first slip, according to an embodiment.
Figure 4:
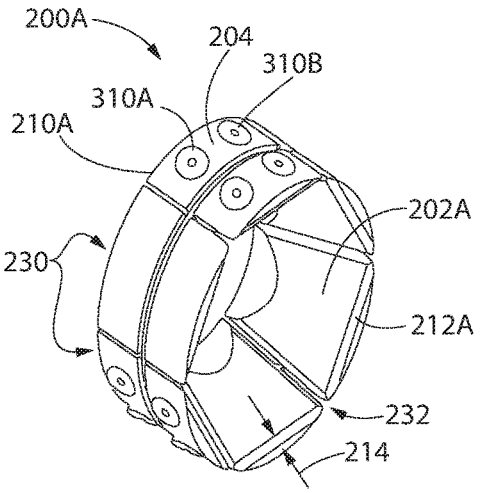
FIG. 4 illustrates a perspective view showing a lower end of the first slip, according to an embodiment.
Figure 5:
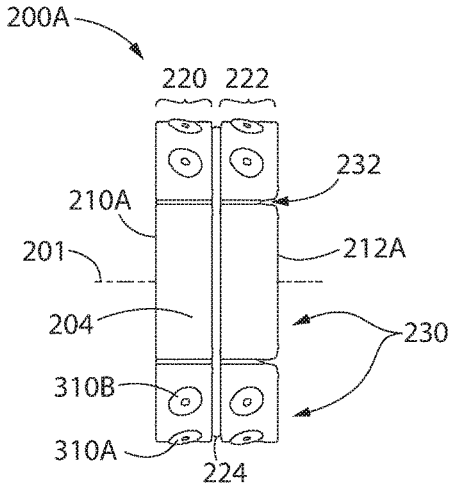
FIG. 5 illustrates a side view of the first slip, according to an embodiment.

FIG. 3 illustrates a perspective view showing an upper axial end 210A of the upper slip 200A, FIG. 4 illustrates a perspective view showing a lower axial end 212A of the upper slip 200A, and FIG. 5 illustrates a side view of the upper slip 200A, according to an embodiment. The upper axial end 212A of the upper slip 200A may have a greater thickness 214 than the lower axial end 212A of the upper slip 200A due to the tapered inner surface 202A. As a result, the upper axial end 210A of the upper slip 200A may also be referred to as the "thicker axial end," and the lower axial end 212A of the upper slip 200A may also be referred to as the "thinner axial end."

The upper slip 200A may include a plurality of segments (six are shown: 230) that are circumferentially-offset from one another. As such, axial gaps 232 may be positioned circumferentially-between two adjacent segments 230. In another embodiment, the segments 230 may initially be coupled together but configured to break apart when exposed to a predetermined force (e.g., during setting of the downhole tool 100). Each segment 230 may include one or more rows (two are shown: 220, 222) that are axially-offset from one another with respect to a central longitudinal axis 201 through the upper slip 200A. A circumferential groove 224 may be positioned in the outer surface 204 of the upper slip 200A and axially-between the two rows 220, 222. In other embodiments, the groove 224 may be in the outer surface 204 and axially-above the rows 220, 222, in the outer surface 204 and axially-below the rows 220, 222. A band (not shown) may be placed at least partially into the circumferential groove 224 to hold the segments 230 in place around the mandrel 110. The band may be configured to break when exposed to a predetermined force during the setting of the downhole tool 100.

At least some of the segments 230 of the upper slip 200A may include one or more buttons 310A, 310B on the outer surface 204 thereof. As shown, each segment 230 that includes buttons 310A, 310B may have, for example, four buttons 310A, 310B (e.g., two buttons in each row 220, 222). As described in greater detail below, the two buttons 310A, 310B in a single row 220, 222 may be coupled to or integral with one another, although buttons 310A, 310B in two different rows 220, 222 may also or instead be coupled together or integrally formed. Optionally, at least some of the segments 230 of the upper slip 200A may not include any buttons 310A, 310B. As shown, the segments 230 that include buttons 310A, 310B may alternate with segments 230 that do not include buttons 310A, 310B, as proceeding in a circumferential direction around the upper slip 200A. Thus, in the example shown, the upper slip 200A may include six segments 230, with three of the segments 230 including buttons 310A, 310B. However, in other embodiments, the percentage of segments 230 including buttons 310A, 310B may vary between about 25% and about 100%.

Figure 6:
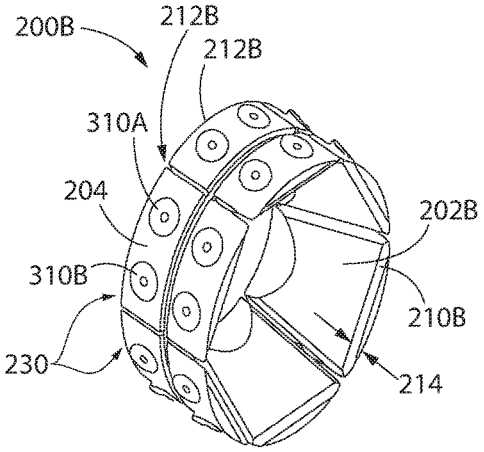
FIG. 6 illustrates a perspective view showing an upper end of a second slip, according to an embodiment.
Figure 7:
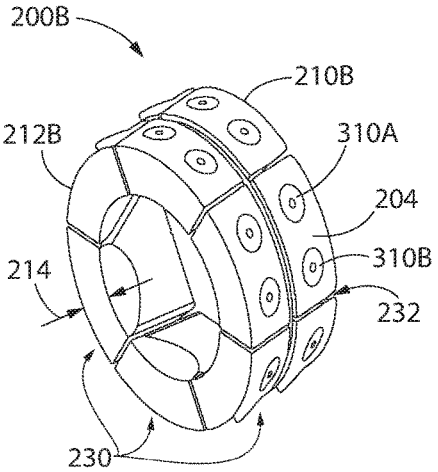
FIG. 7 illustrates a perspective view showing a lower end of the second slip, according to an embodiment.
Figure 8:
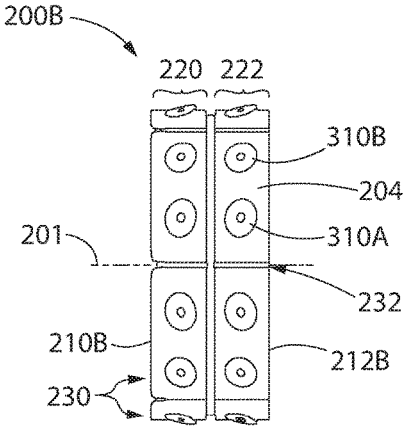
FIG. 8 illustrates a side view of the second slip, according to an embodiment.

FIG. 6 illustrates a perspective view showing an upper axial end 210B of the lower slip 200B, FIG. 7 illustrates a perspective view showing a lower axial end 212B of the lower slip 200B, and FIG. 8 illustrates a side view of the lower slip 200B, according to an embodiment. The lower slip 200B may be similar to the upper slip 200A, except for a few differences. For example, the upper axial end 210B of the lower slip 200B may have a lesser thickness 214 than the lower axial end 212B of the lower slip 200B due to the tapered inner surface 202B described above. As a result, the upper axial end 210B of the lower slip 200B may also be referred to as the "thinner axial end," and the lower axial end 212B of the lower slip 200B may also be referred to as the "thicker axial end."

In addition, the lower slip 200B may include a greater percentage of segments 230 that include buttons than the upper slip 200A. This is because the pressure exerted on the downhole tool 100 may be greater above the downhole tool 100 than below the downhole tool 100 once the downhole tool 100 is set. As a result, the lower slip 200B may provide a greater proportion of the anchoring force against the surrounding tubular (e.g., casing) or wellbore wall. As shown, each of the six segments 230 may include four buttons 310A, 310B (e.g., two buttons 310A, 310B in each row 220, 222) However, in other embodiments, the percentage of segments 230 on the lower slip 200B that includes buttons 310A, 310B may vary between about 25% and about 100%.

Figure 9:
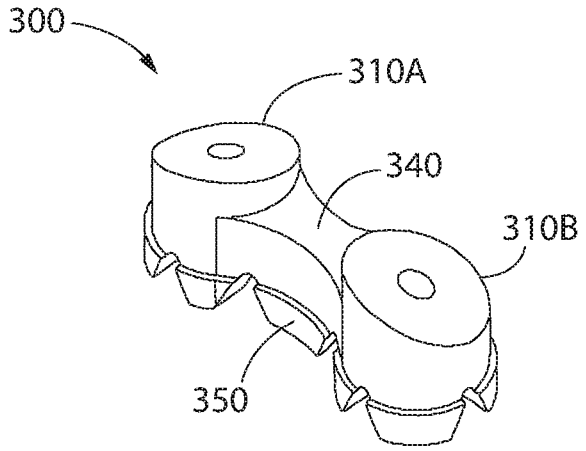
FIG. 9 illustrates a perspective view of an insert that may be coupled to a segment in one of the slips, according to an embodiment.
Figure 10:
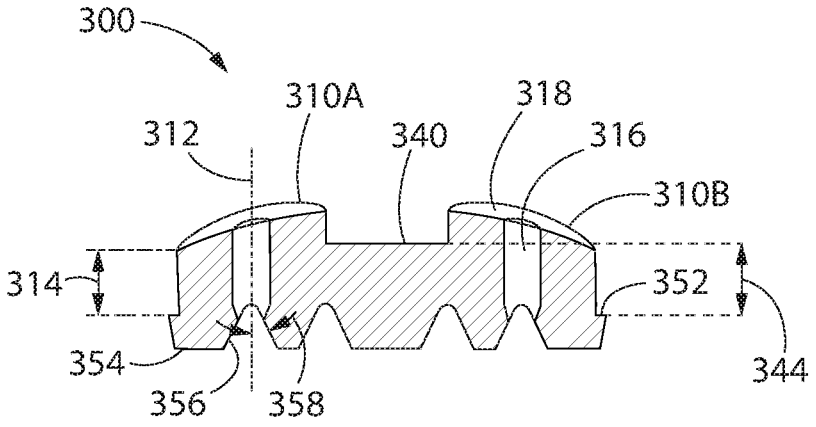
FIG. 10 illustrates a cross-sectional side view of e insert, according to an embodiment.

FIG. 9 illustrates a perspective view of an insert 300 that may be coupled to one of the segments 230, and FIG. 10 illustrates a cross-sectional side view of the insert 300, according to an embodiment. The insert 300 may include two (or more) buttons 310A, 310B, a connecting member 340, and a base 350. As shown, the insert 300 includes two buttons 310A, 310B and a single connecting member 340; however, in other embodiments, the insert 300 may include three or more buttons and two or more connecting members. The buttons 310A, 310B may be made of a ceramic material, metal (e.g., cast iron), or a combination thereof. Various surface treatments (e.g., case hardening) may be applied to the outer surface of the buttons 310A, 310B.

An axial thickness 314 of the buttons (e.g., with respect to a central longitudinal axis 312 through the buttons 310A, 310B) may decrease proceeding away from the connecting member 340. As such, the buttons 310A, 310B may extend axially-farther from the base 350 proximate to the connecting member 340 than distal to the connecting member 340. The buttons 310A, 310B may optionally have a bore 316 extending from the outer surface 318 toward the base 350. The bore 112 may reduce the amount of material needed to manufacture the buttons 310A, 310B and may facilitate the buttons 310A, 310B breaking up during the milling process. In addition, the bore 316 may be used during the installation of the insert 300 into a mold or onto the slip 200A, 200B.

The connecting member 340 may be coupled to or integral with the buttons 310A, 310B and positioned between the buttons 310A, 310B. The connecting member 340 may be made of the same material as the buttons 310A, 310B (e.g., ceramic material, metal, etc.). An axial thickness 344 of the connecting member 340 may be less than the axial thickness 314 of the buttons 310A, 310B with respect to the central longitudinal axis 312. As such, the buttons 310A, 310B may extend axially-outward farther than the connecting member 340. Said another way, the connecting member 340 may define a recess between the buttons 310A, 310B.

The base 350 may be coupled to or integral with the buttons 310A, 310B and the connecting member 340. The base 350 may be made of composite material, ceramic material, metal, or a combination thereof. The base 350 may extend laterally-outward and/or radially-outward from the buttons 310A, 310B and the connecting member 340 with respect to the central longitudinal axis 312. As such, the base 350 may define a lip 352. The lip 352 may provide a surface area that helps secure the insert 300 in the slip 200A, 200B.

An inner surface 354 of the base 350 may define one or more grooves 356. The grooves 356 may be oriented at an angle 358 with respect to the central longitudinal axis 312. The angle 358 may be from about 10° to about 50°. For example, the angle 358 may be about 30°. The grooves 356 may have a rounded point (e.g., a radius of curvature) or a sharp point. The grooves 356 may reduce the amount of material needed to manufacture the insert 300. In addition, the grooves 356 may act as a stress concentrator that facilitates the insert 300 breaking into smaller pieces when the downhole tool 100 is milled-out of the wellbore.

Figure 11:
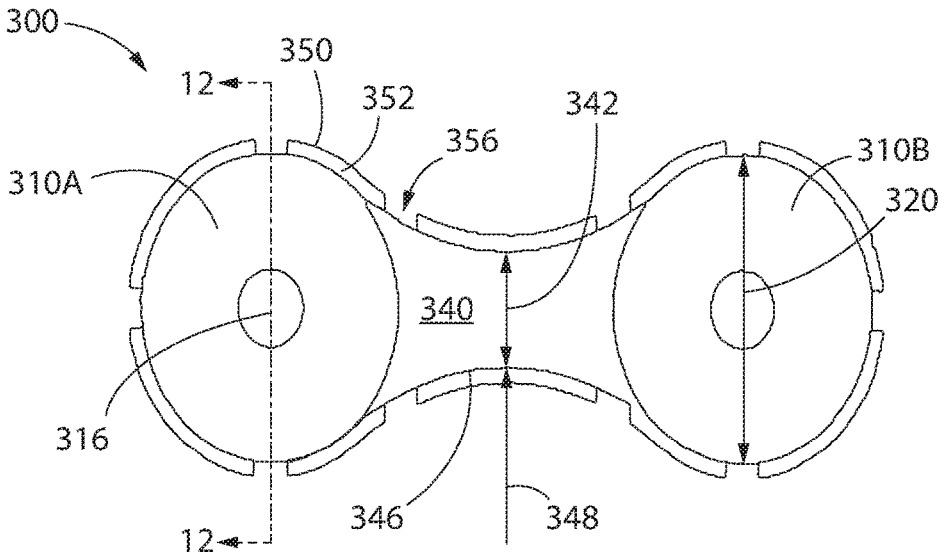
FIG. 11 illustrates a top view of the insert, according to an embodiment.

FIG. 11 illustrates a top view of the insert 300, according to an embodiment. The buttons 310A, 310B may be substantially circular in shape with a lateral thickness (e.g., diameter) 320 ranging from about 0.4 inches to about 1.0 inch (e.g., about 0.5 inches). A lateral thickness 342 of the connecting member 340 may be less than the lateral thickness (e.g., diameter) 320 of the buttons 310A, 310B. As shown, the side surfaces 346 of the connecting member 340 that define the lateral thickness 342 may have a radius of curvature 348. The radius of curvature 348 may be from about 0.25 inches to about 1 inch (e.g., about 0.5 inches). Thus, the insert 300 may be in the shape of a "dog bone." As shown in FIG. 11, the grooves 356 in the base 350 may extend laterally-outward and/or radially-outward from the buttons 310A, 310B and the connecting member 340. As such, the grooves 356 may extend through the lip 352.

Figure 12:
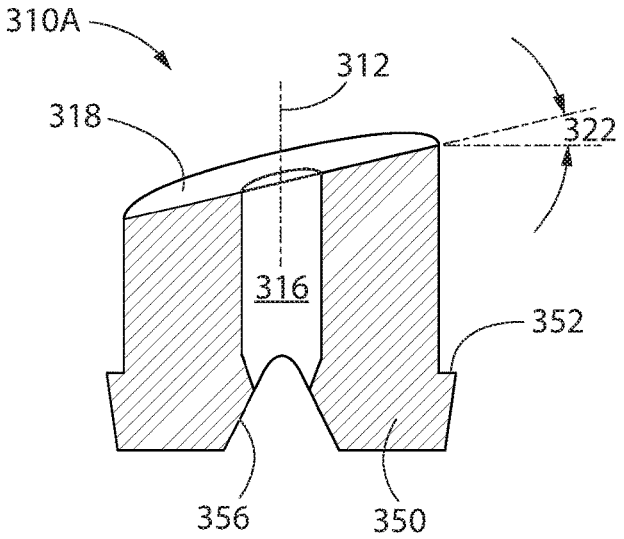
FIG. 12 illustrates a cross-sectional side view of one of the buttons of the insert taken through 12-12 in FIG. 11, according to an embodiment.

FIG. 12 illustrates a cross-sectional side view of one of the buttons 310A of the insert 300 taken through line 12-12 in FIG. 11, according to an embodiment. The outer surface 318 of the button 310A may be oriented at an angle 322 with respect to the base 350 of the insert 300. In at least one embodiment, the base 350 may be aligned with the central longitudinal axis 201 through the slip 200A, 200B. Thus, the angle 322 may also be with respect to the central longitudinal axis 201 through slip 200A, 200B (e.g., before the downhole tool 100 is set). The angle 322 may be from about 5° to about 20° or from about 8° to about 13°. In one example, the angle 322 may be about 10.85°. In another embodiment, the outer surface 318 may be flat and parallel to the connecting member 340 (i.e., the angle may be 0°).

The outer surface 318 of the button 310A may be rough. For example, a grit (e.g., abrasive particles or granules) may be adhered onto the outer surface 318 to give the outer surface 318 a texture similar to sandpaper. The grit may improve the engagement between the button 3104 and the outer tubular.

Figure 13:
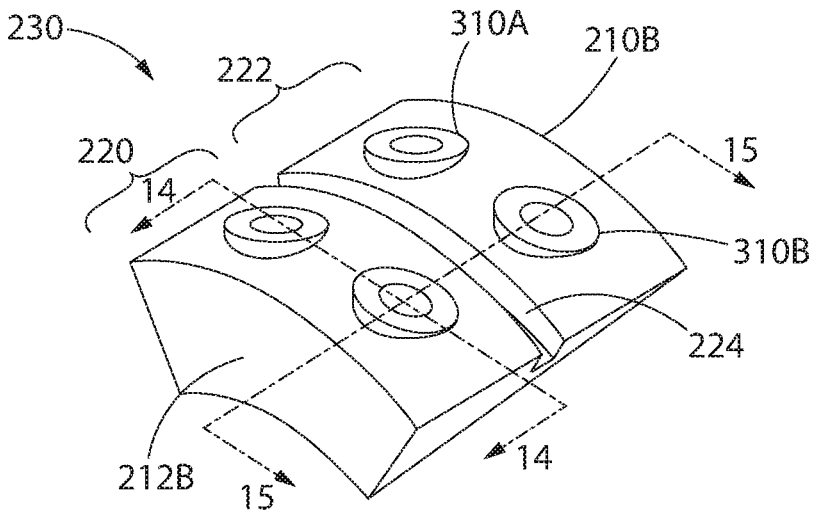
FIG. 13 illustrates a perspective view of one of the segments, according to an embodiment.

FIG. 13 illustrates a perspective view of one of the segments 230, according to an embodiment. More particularly, FIG. 13 illustrates a segment 230 including two axially-offset rows 220, 222. Each row 220, 222 may include one insert 300. Line 14-14 may be taken through a plane that is perpendicular to the central longitudinal axis 201 through the segment 230. Line 15-15 may be taken through a plane that is parallel to the central longitudinal axis 201 through the segment 230.

Figure 14:
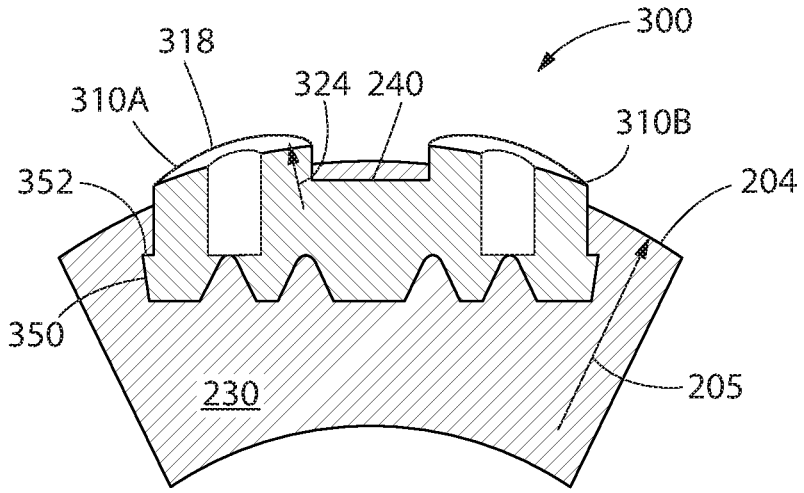
FIG. 14 illustrates a cross-sectional view of the segment taken through line 14-14 in FIG. 13, according to an embodiment.

FIG. 14 illustrates a cross-sectional view of the segment 230 taken through line 14-14 in FIG. 13, according to an embodiment. The view of FIG. 14 is parallel to the central longitudinal axis 201 through the segment 230. As shown, the insert 300 may be at least partially embedded within the outer surface 204 of the segment 230. A molding material may be used to secure the insert 300 in place, as discussed in greater detail below. The molding material may be placed over the connecting member 340. The molding material may also be placed over the lip 352 of the base 350. The molding material may be or include an uncured or otherwise flowable or formable composite material that solidifies around the inserts 300 to form the slip segment 230.

The outer surfaces 318 of the buttons 310A, 310B may have a radius of curvature 324 when looking at the view shown in FIG. 14 (i.e., in a direction parallel to the central longitudinal axis 201 through the slips 200A, 200B). The radius of curvature 324 may be within about 10% of a radius of curvature 205 of the outer surface 204 of the segment 230. In another embodiment, the radius of curvature 324 may be within about 10% of a radius of curvature of the outer tubular or wellbore wall that the insert 300 is configured to contact when the downhole tool 100 is set. This radius of curvature 324 may increase the surface area of the outer surface 318 of the buttons 310A, 310B that contacts the outer tubular or wellbore wall when the downhole tool 100 is set, thereby increasing the anchoring force of the downhole tool 100. In another embodiment, the outer surfaces 318 of the buttons 310A, 310B may be tapered and planar (i.e., no radius of curvature 324).

The size, shape (e.g., angle 322, radius of curvature 324, etc.), number, and positioning of the buttons 310A, 310B on the slip segments 230 may allow the buttons 310A, 310B on the slip segments 230 to have a greater surface area in contact with the outer tubular when compared to conventional slips. Further, the size and shape of the base 350, which may be relatively large in comparison to either one of the buttons 310A, 310B taken alone, may prevent the buttons 310A, 310B from "punching through" the slip segments 230. For example, the geometry of the base 350, including the lip 352 and the grooves 356, may increase the surface area of the inserts 300 that contacts the slip segments 230, which may reduce the likelihood that the insert 300 may punch radially-inward through the slip segment 230.

Figure 15:
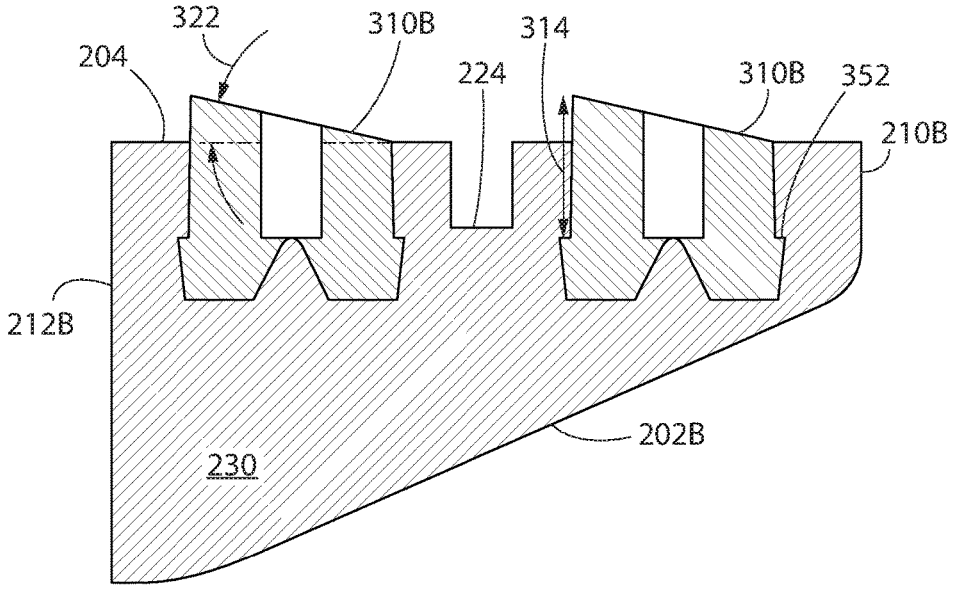
FIG. 15 illustrates a cross-sectional view of the segment taken through line 15-15 in FIG. 13, according to an embodiment.

FIG. 15 illustrates a cross-sectional view of the segment 230 taken through line 15-15 in FIG. 13, according to an embodiment. The view shown in FIG. 15 is in the circumferential direction. As mentioned above, the outer surfaces 318 of the buttons 310A, 310B may be oriented at the angle 322 with respect to the base 350 of the insert 300 and/or the central longitudinal axis 201 through the segment 230. The angle 322 may be such that a distance between the outer surface 318 of the button 310A and the central longitudinal axis 201 increases proceeding toward the thicker axial end of the segment 230 (i.e., the lower end 212B of the lower slip 200B; the upper end 210A of the upper slip 200A). For example, the outer surface 318 of the button 310A may be close to flush with the outer surface 204 of the segment 230 on the side of the button 310A closest to the thinner axial end 210B, 212A of the segment 230, and the outer surface of the button 318 may be positioned radially-outward from the outer surface 204 of the segment 230 on the side of the button 310A closest to the thicker axial end 210A, 212B of the segment 230.

Figure 16:
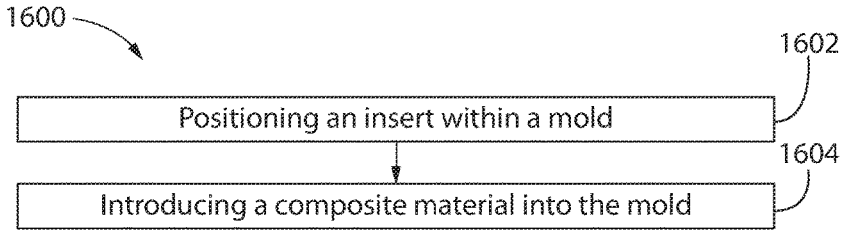
FIG. 16 illustrates a flowchart of a method for manufacturing a segment of a slip, according to an embodiment.
Figure 17:
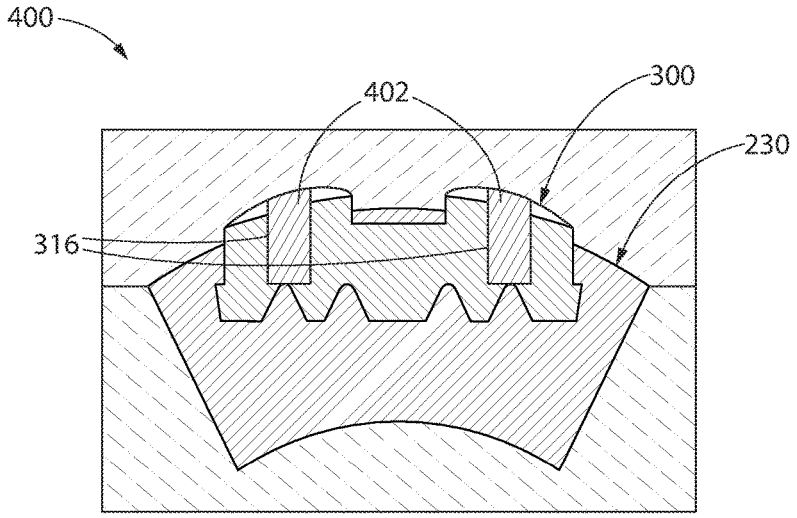
FIG. 17 illustrates a segment of a slip being manufactured in a mold, according to an embodiment.

FIG. 16 illustrates a flowchart of a method 1600 for manufacturing a segment 230 of a slip 200A, 200B, and FIG. 17 illustrates a segment 230 being manufactured in a mold 400, according to an embodiment. The method 1600 may include positioning one or more inserts 300 within a mold 400, as at 1602. The inserts 300 may be positioned circumferentially-offset from one another and/or axially-offset from one another within the mold 400.

The method 1600 may then include introducing a composite material into the mold 400, as at 1604. In at least one embodiment, the composite material may be heated when it is introduced into the mold 400. In another embodiment, the composite material may be uncured when introduced into the mold 400. The composite material may form an arcuate slip segment 230 in the mold 400. The inserts 300 may be at least partially embedded within the outer surface 204 of the segment 230. At least a portion of the composite material may solidify over the connecting members 340 of the inserts 300 to at least partially embed the inserts 300 within the segment 230. In addition, at least a portion of the composite material may solidify over the lips 352 of the inserts 300 to embed the inserts 300 within the segment 230. The inserts 300 may be held in place during the molding process by a dowel or rod 402 received through the bore 316. The dowel or rod 402 may be part of the mold 400 or may be a separate component.

Figure 18:
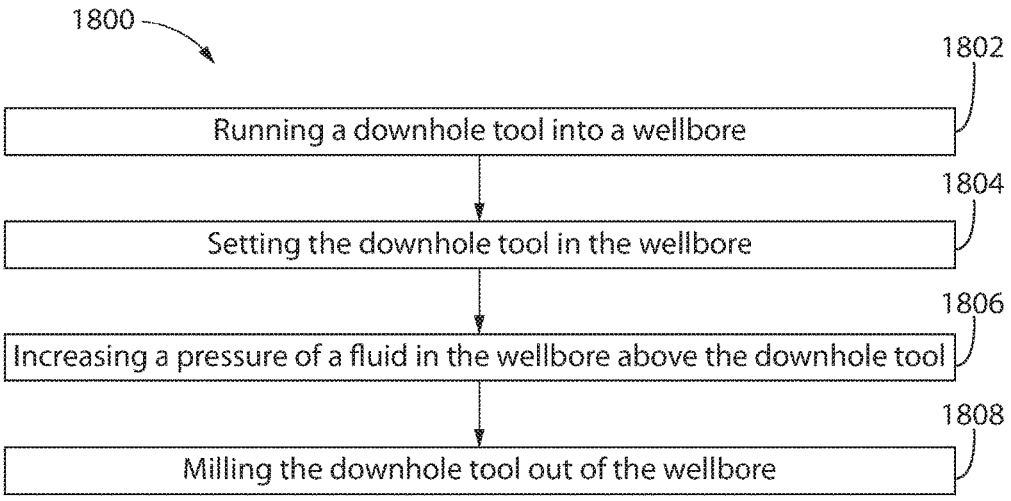
FIG. 18 illustrates a flowchart of a method for setting the downhole tool in a wellbore, according to an embodiment.

FIG. 18 illustrates a flowchart of a method 1800 for setting the downhole tool 100 in a wellbore, according to an embodiment. The method 1800 may include running the downhole tool 100 into a wellbore to a desired location, as at 1802. The method 1800 may then include setting the downhole tool 100 in the wellbore, as at 1804. Setting the downhole tool 100 may include applying opposing axial forces on the mandrel 110 and the push sleeve 114. For example, the mandrel 110 may be held stationary while a setting sleeve applies a downward axial force on the push sleeve 114. This may cause the push sleeve 114 to move toward the shoe 140, applying a compressive force to the components positioned therebetween (i.e., the slips 200A, 200B, the cones 120A, 120B, and the sealing elements 150, 152).

The compressive force may cause the sealing elements 150, 152 to expand radially-outward and into contact with an outer tubular (e.g., casing) or the wellbore wall. This may isolate the portions of the annulus (e.g., between the downhole tool 100 and the outer tubular or wellbore wall) above and below the downhole tool 100.

In addition, the compressive force may cause the axial distance between slips 200A, 200B to decrease, and cause the slips 200A, 200B to expand radially-outward. More particularly, the inner surface 202A of the upper slip 200A may slide downward along the outer surface 122 of the upper cone 120A. The tapered arrangement of the surfaces 202A, 122 of the upper slip 200A and the upper cone 120A may cause the upper slip 200A to expand radially-outward as the upper slip 200A moves downward. Similarly, the outer surface 122 of the lower cone 120B may slide downward along the inner surface 202B of the lower slip 200B. The tapered arrangement of the surfaces 202B, 122 of the lower slip 200B and the lower cone 120B may cause the lower slip 200B to expand radially-outward as the lower cone 120B moves downward. The band in the circumferential groove 224 may break as the slips 200A, 200B expand radially-outward.

As mentioned above, the outer surfaces 318 of the buttons 310A, 310B may be oriented at an angle 322 (e.g., 10.85°) with respect to the central longitudinal axis 201 through the slips 200A, 200B before the downhole tool 100 is set. However, as the slips 200A, 200B expand radially-outward, the thinner axial ends 2108, 212A of the slips 200A, 200B may move radially-outward slightly more than the thicker axial ends 210A, 212B of the slips 200A, 200B This may cause the angle 322 to decrease as the slips 200A, 200B expand radially-outward. The angle 322 may decrease to, for example, about 5° to about −5° with respect to the central longitudinal axis 201 through the slips 200A, 200B. For example, the angle 322 may decrease to about 0° (i.e., parallel to the central longitudinal axis 201 through the slips 200A, 200B). This may increase the surface area of the outer surfaces 318 of the buttons 310A, 310B that contacts the outer tubular (e.g., casing) or wellbore wall, which may increase the anchoring force of the downhole tool 100.

The method 1800 may then include increasing a pressure of a fluid in the wellbore above the downhole tool 100 (e.g., using a pump at the surface), as at 1806. The pressure may be increased to, for example, fracture a portion of the subterranean formation above the downhole tool 100. The method 1800 may then include milling the downhole tool 100 out of the wellbore using a milling tool, as at 1808. As mentioned above, the grooves 356 in the base 350 of the insert 300 may reduce the force necessary to break apart the inserts 300 during milling.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. An insert for a slip of a downhole tool, comprising:

a base defining an inner surface, wherein the base is configured to be embedded into the slip of the downhole tool;

a first button extending from the base, away from the inner surface, and configured to engage an inner diameter surface of a tubular;

a second button extending from the base, away from the inner surface, and configured to engage the inner diameter surface of the tubular; and a connecting member extending from the base and positioned between the first button and the second button, wherein the base defines a groove configured to be embedded in the slip, wherein the groove extends from the inner surface of the base toward the first button, the connecting member, or both, wherein the first button defines a diameter, and wherein a maximum lateral thickness of the connecting member is less than the diameter of the first button.

2. The insert of claim 1, wherein a side surface of the connecting member comprises a radius of curvature.

3. The insert of claim 1, wherein an axial thickness of the first button is greater than an axial thickness of the connecting member, such that the first button extends farther outward from the base than the connecting member.

4. The insert of claim 3, wherein the axial thickness of the first button decreases proceeding away from the connecting member such that an outer surface of the first button forms an angle with respect to the base, wherein the angle is from about 5° to about 20°.

5. The insert of claim 1, wherein the first button has a bore formed at least partially axially-therethrough with respect to a central longitudinal axis through the first button.

6. The insert of claim 1, wherein the base extends laterally-outward from the first button, the connecting member, or both, such that the base defines a lip.

7. The insert of claim 1, wherein a portion of the inner surface of the base that defines the groove is oriented at an angle with respect to a central longitudinal axis through the first button, and wherein the angle is from about 10° to about 50°.

8. An insert for a slip of a downhole tool, comprising:

a base defining an inner surface, wherein the base is configured to be embedded into the slip of the downhole tool;

a first button extending from the base, away from the inner surface, and configured to engage an inner diameter surface of a tubular;

a second button extending from the base, away from the inner surface, and configured to engage the inner diameter surface of the tubular; and a connecting member extending from the base and positioned between the first button and the second button, wherein the base defines a groove configured to be embedded in the slip, wherein the groove extends from the inner surface of the base toward the first button, the connecting member, or both, and wherein an outer surface of the first button comprises a radius of curvature as proceeding circumferentially toward the second button, and wherein the radius of curvature is within about 10% of a radius of curvature of the inner diameter surface of the tubular.

9. A slip segment for a downhole tool, comprising:
an arcuate body; and
an insert comprising:
a base at least partially embedded within an outer surface of the body;
a first button extending outward from the base and configured to engage an inner diameter of a tubular;
a second button extending outward from the base and configured to engage the inner diameter of the tubular; and
a connecting member extending outward from the base and positioned between the first button and the second button,
wherein the base defines a plurality of grooves formed therein, wherein a portion of the body is positioned within the grooves, wherein an outer surface of the first button comprises a radius of curvature as proceeding circumferentially toward the second button, and wherein the radius of curvature is within about 10% of a radius of curvature of the inner diameter of the tubular.

10. The slip segment of claim 9, wherein the body comprises a first row, a second row, and a circumferential groove, and wherein the first and second buttons of the insert are positioned in the first row.

11. The slip segment of 9, wherein the connecting member is embedded within the body, such that a portion of the body is between the buttons and over the connecting member.

12. The slip segment of claim 9, wherein the base defines a lip that extends laterally-outward from the buttons, the connecting member, or a combination thereof, and wherein a portion of the body is positioned over the lip and over the connecting member.

13. The slip segment of claim 9, wherein the body is made of a composite material, and wherein the insert is made of a metallic material, a ceramic material, or a combination thereof.

14. An insert for a slip of a downhole tool, comprising:
a base defining an inner surface, wherein the base is configured to be positioned in the slip of the downhole tool;
a first button extending from the base, away from the inner surface, and configured to engage an inner diameter surface of a tubular;
a second button extending from the base, away from the inner surface, and configured to engage the inner diameter surface of the tubular; and
a connecting member extending from the base and positioned between the first button and the second button, wherein an outer surface of the first button is curved as proceeding toward the second button.

15. The insert of claim 14, wherein the outer surface of the first button defines a radius of curvature that is within about 10% of a radius of curvature of the inner diameter surface of the tubular.

16. The insert of claim 14, wherein the base defines a groove configured to be embedded in the slip, wherein the groove extends from the inner surface of the base toward the first button, the connecting member, or both.

17. The insert of claim 16, wherein the groove defines a stress-concentrating point or edge in the base.

* * * * *